United States Patent [19]

Black

[11] 4,381,712

[45] May 3, 1983

[54] BALL-ACTUATED TUBULAR PROJECTILE

[75] Inventor: William L. Black, China Lake, Calif.

[73] Assignee: The United States of America as represented by the Secretary of the Navy, Washington, D.C.

[21] Appl. No.: 252,738

[22] Filed: Apr. 10, 1981

[51] Int. Cl.[3] ..... F42B 11/00

[52] U.S. Cl. ..... 102/503; 102/501; 29/1.2; 29/441 R

[58] Field of Search ..... 102/501, 503, 235, 236, 102/244, 245, 246, 254; 29/1.2, 1.21, 1.22, 1.23, 151.1 R, 441 R, 441 BP

[56] References Cited

U.S. PATENT DOCUMENTS

| | | | |
|---|---|---|---|
| 1,376,530 | 5/1921 | Greener . | |
| 2,324,551 | 7/1943 | Albree | 102/50 |
| 2,386,054 | 10/1945 | McGee . | |
| 2,433,334 | 12/1947 | Birkeland | 102/50 |
| 2,974,595 | 3/1961 | Mohaupt | 102/56 |
| 3,621,781 | 11/1971 | Johnsen | 102/38 |
| 3,661,086 | 5/1970 | Thomanek et al. | 102/56 |
| 3,738,275 | 6/1973 | Schwartz et al. | 102/70.2 |
| 3,991,682 | 11/1976 | Peak | 102/38 |
| 4,212,244 | 7/1980 | Flatau | 102/503 |
| 4,258,625 | 3/1981 | Black | 102/503 |

*Primary Examiner*—Harold J. Tudor

*Attorney, Agent, or Firm*—R. F. Beers; W. Thom Skeer

[57] ABSTRACT

An improved tubular projectile formed from a single piece body member having a ball valve resiliently held in a closed position therein and a method of manufacture is disclosed.

21 Claims, 1 Drawing Figure

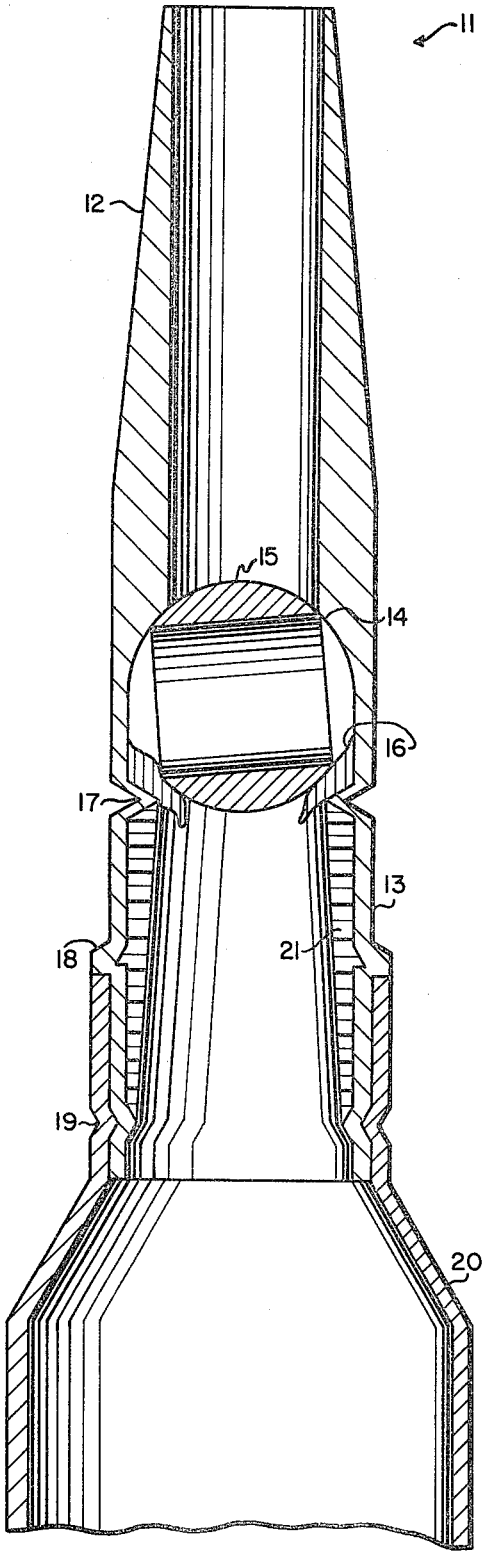
11
12
15
14
16
17
13
18
21
19
20

BALL-ACTUATED TUBULAR PROJECTILE

BACKGROUND OF THE INVENTION

1. Field of the Invention

This invention pertains to the field of metal working. More particularly, this invention pertains to the making of projectiles. By way of further characterization the invention will be described as it pertains to the making of tubular projectiles having a ball-actuated valve located within said projectile. By way of further characterization, the invention will describe a projectile made by metal working a stepped cylinder so as to produce an improved ball-actuated tubular projectile having a lower fabrication cost than those heretofore known. Additionally, the invention relates to a ball-actuated tubular projectile made by these processes.

2. DESCRIPTION OF THE PRIOR ART

Tubular projectiles have been known in the prior art since the turn of the century. However, prior art tubular projectiles have required a sabot to be either inserted within the tubular conduit of the projectile or fitted around the base end thereof so as to prevent propelling gases from escaping through the gun barrel by way of the internal conduit passing through said projectile. Although satisfactory for limited purposes, such projectiles have inadequacies in certain military applications. For example, in an aircraft having an airbreathing engine the ingestion of the sabots after separation from the projectiles often causes premature and deleterious engine failure. Additionally, in land based weaponry the separation of the sabot frequently impacts areas outside the intended target areas exposing friendly personnel to the hazards of injury due to impaction by said sabots.

Additionally, in recent times, it has been known to provide an internal ball-actuated valve to replace the sabot such that a unitary projectile is formed. Such projectiles have the advantage of being able to be used by aircraft having airbreathing engines and to fire over friendly occupied territory. However, known fabrication techniques have used two part projectile bodies having an internal valve and require expensive fitting and testing in the fabrication, thereby raising the cost of these projectiles to make them unattractive for mass production as would be required for standard military arms.

SUMMARY OF THE INVENTION

This invention provides for an improved projectile made from a single pieced body casing having a ball valve fitted to a seat formed on a thick walled nose portion. The ball valve is held in the closed position by means of a rubber washer and a cannelure formed in the thin walled portion of the projectile body such that the washer is compressed holding the ball in the desired shape until rotational velocity from the gun barrel causes self-alignment in the conventional fashion.

Accordingly it is an object of this invention to provide an improved tubular projectile.

A further object of this invention is to provide a method for manufacture of a ball-actuated tubular projectile having a lower cost and higher reliability than heretofore known methods.

A still further object of this invention is the provision of a ball actuated tubular projectile having unitary construction techniques.

A further object of this invention is a provision of a method of fabrication of a ball-actuated tubular projectile using a minimum of high cost fabrication steps.

These and other objects of the invention will be better understood by reference to the following detailed description, appended claims, and drawings.

BRIEF DESCRIPTION OF THE DRAWING

The single FIGURE is a longitudinal section of a projectile made according to the invention seated in a cartridge case.

DESCRIPTION OF THE PREFERRED EMBODIMENT

Referring to FIG. 1, the projectile according to the invention is indicated generally at 11. Projectile 11 has a nose portion 12 which tapers from a full cylinder section to a nose section and having an axial bore extending therethrough. A tail section 13 is formed integrally with said nose section 11 and differs therefrom in having significantly thinner sidewalls such as to permit deformation by conventional metal working processes. A valve seat 14 is formed in the aft end of the thicker wall sections of nose portion 12.

The forming of valve seat 14 may be accomplished by conventional techniques such as machining or grinding, or valve seat 14 may be formed in situ during a forging operation well understood in the metal working. A ball check valve 15 is seated on valve seat 14 with the longitudinal aperture thereof turned such as to close the axial bore extending through projectile 11.

A washer of rubber-like material 16 is placed on valve seat 14 and held in place by a cannelure 17. Washer 16 may be made of any resilient material with rubber-like qualities. That is, it should be deformable when cannelure 17 is formed in the thinner wall section 13 of the tail portion of projectile 11 but still having insufficient mechanical strength to prevent valve 15 from rotating during acceleration of the projectile within a gun barrel.

Cannelure 17 is placed on tail portion 13 by conventional techniques such as crimping or rolling, for example. A rotational band 18 is provided on the exterior wall of tail section 13 to provide indexing for cartridge case 20 and to provide rifling engagement.

Band 18 may be formed integrally from skirt material by conventional metal working techniques. If desired, band 18 may be attached to the skirt by oven brazing or other fusing techniqure if suitable band material is used. If a non-metallic material is used for band 18 the thinner wall section 13 may be deformed to provide a well for in situ molding. This well or annular groove may be a rearward extention of crimp 17, if desired, to simplify construction. Of course, for non-metallic materials a chemical bonding material is used to secure band 18 to the projectile.

It should be noted that rotational band 18 also serves as a gas check. It has been observed, in tubular projectiles, the tail section expands radially outwardly to provide additional bore engagement and gas sealing function. Therefore, rotational band 18 need not be designed to provide the total rotational engagement required. In polygonal bores, the band 18 may be omitted since skirt expansion will provide both rotational engagement and gas sealing functions.

Case 20 is held to projectile 13 by conventional cannelure 19 which may be formed in the same fashion as cannelure 17.

If desired, a chemical deposit indicated at 21 may be placed within the axial bore of projectile 11 to facilitate observation of the bullet's trajectory. A fumer of conventional composition may be used to produce a smoke-like vapor trail and an ember-like light emission. On the other hand, a tracer material having illuminous gas as a combustion product may be used, if desired. Both of these chemicals are well known and, in the invention, are used in the conventional fashion according to standard practice in the industry.

The materials used in the fabrication of projectile 11 are conventional ballistic materials and may include, for example, stainless steel, copper, lead, and other conventional materials. The nose-portion 12 of projectile 11 may be formed by machining or swaging in dependence on the material used. It is contemplated that a swaged or machined preform having thicker walls over a portion of its length and thinner walls over the remainder will be used as a raw material for the large-scale production of the projectile. Such a blank or preform would be manufactured by well-known, conventional techniques in the metal working art. For example, such preforms may be cast, machined on a numerically controlled cutting or grinding machine, or swaged from a softer material such as copper or brass.

The foregoing description taken together with the appended claims constitute an invention disclosure to enable a person skilled in the metal working and ordnance arts to make and use the invention. Further, the aforedescribed method and product constitutes a meritorius advance in the ordnance arts unobvious to such an artisan not having the benefit of these teachings.

What is claimed is:

1. A tubular projectile having an axial bore, comprising:

a body having;

a tail portion having walls defining said axial bore;

a nose portion having relatively thick walls with respect to the walls of said tail portion;

a valve seat formed in said nose portion in said thick walls;

an apertured spherical ball supported on said valve seat for rotation thereon;

a washer contacting said spherical ball valve in opposing relationship to said valve seat; and a cannelure in the walls of said tail portion adjacent said washer for holding said ball valve in a predetermined position and for providing a seal therefor.

2. A tubular projectile according to claim 1 wherein said nose portion has an external surface which tapers forwardly to reduce the wall thickness at the nose thereof to promote aerodynamic gas flow about said tubular projectile.

3. A tubular projectile according to claim 1 wherein said valve seat has a spherically shaped surface.

4. A tubular projectile according to claim 1 wherein said washer is made of a resilient material.

5. A tubular projectile according to claim 4 wherein said resilient material is made of rubber-like material.

6. A tubular projectile according to claim 1 wherein the walls of said tail portion are coated with a tracer material to enhance tracking of the projectile.

7. A tubular projectile according to claim 1 wherein the walls of said tail portion are coated with a fumer material to enhance tracking of the projectile.

8. A tubular projectile according to claim 1 wherein the walls of said tail portion have a cannelure whereby a casing may be crimped to said projectile.

9. A method of making a projectile comprising:

forming a tubular body having a thick walled nose portion adjoining a thin walled tail portion;

shaping said thick walls at the junction of said nose and tail portions to form a spherically surfaced valve seat;

placing an apertured spherical valve on said valve seat in a predetermined position;

inserting a resilient washer in said tail portion to rest on said spherical valve; and producing a cannelure in said thin walled tail portion to reduce the axial bore thereof at a position adjacent said washer to compress said washer so as to secure said valve in said predetermined position.

10. A method of making a projectile according to claim 9 wherein said tubular body is formed by swaging.

11. A method of making a projectile according to claim 9 wherein said tubular body is formed by machining said nose portion walls and said tail portion walls.

12. A method of making a projectile according to claim 9 wherein said spherically surfaced valve seat is shaped by grinding.

13. A method of making a projectile according to claim 9 wherein said spherically surfaced valve seat is shaped by machining.

14. A method of making a projectile according to claim 9 wherein said aperture spherical valve is placed on said valve seat with the longitudinal axis of the aperture perpendicular to the longitudinal axis of said projectile.

15. A method of making a projectile according to claim 9 wherein said cannelure is produced by crimping the thin walled tail portion.

16. A method of making a projectile according to claim 9 wherein said cannelure is produced by rolling said thin walled tail section.

17. A method of making a projectile according to claim 9 and coating the walls of said tail portion with a tracer material to facilitate tracking said projectile.

18. A method of making a projectile according to claim 9 and coating said tail portion with a fumer material to facilitate tracking said projectile.

19. A method of making a projectile according to claim 9 further including the production of a second cannelure in said tail portion for attaching said projectile to a casing.

20. A method of making a projectile according to claim 19 wherein the step of production of a second cannelure in said tail portion for attaching said projectile to a casing includes crimping said tail section casing.

21. A method of making a projectile according to claim 19 wherein the step of production of a second cannelure for attaching said projectile to a casing includes rolling said tail section.

* * * * *